US007105954B2

(12) United States Patent
Ray

(10) Patent No.: US 7,105,954 B2
(45) Date of Patent: Sep. 12, 2006

(54) SENSOR INTERFACE CABLE

(75) Inventor: Rand Kalani Ray, Kettering, OH (US)

(73) Assignee: Hyde Park Electronics LLC, Dayton, OH (US)

( * ) Notice: Subject to any disclaimer, the term of this patent is extended or adjusted under 35 U.S.C. 154(b) by 435 days.

(21) Appl. No.: 10/614,854

(22) Filed: Jul. 8, 2003

(65) Prior Publication Data

US 2005/0009399 A1 Jan. 13, 2005

(51) Int. Cl.
*H01B 7/00* (2006.01)

(52) U.S. Cl. ..... 307/147; 307/151

(58) Field of Classification Search ..... 307/147, 307/151

See application file for complete search history.

(56) References Cited

U.S. PATENT DOCUMENTS 4,806,928 A * 2/1989 Veneruso ..... 340/853.3
4,888,494 A * 12/1989 McNair et al. ..... 307/38
5,001,358 A * 3/1991 Matsuoka et al. ..... 307/150
5,243,510 A 9/1993 Cheney, II
5,555,876 A * 9/1996 Francisco et al. ..... 126/504
5,715,156 A 2/1998 Yilmaz et al.
5,869,907 A * 2/1999 Marler ..... 307/10.1
5,892,430 A 4/1999 Wiesman et al.
5,901,056 A 5/1999 Hung
6,137,351 A * 10/2000 Alderman et al. ..... 327/563
6,172,891 B1 1/2001 O'Neal et al.
6,194,881 B1 2/2001 Parker et al.
6,266,261 B1 7/2001 Lanni
6,285,170 B1 9/2001 Matsumoto et al.
6,366,474 B1 4/2002 Gucyski
6,459,175 B1 10/2002 Potega
6,481,939 B1 * 11/2002 Gillespie et al. ..... 409/131
6,483,723 B1 11/2002 Kuranuki et al.
6,496,103 B1 12/2002 Weiss et al.
6,570,146 B1 * 5/2003 Emery et al. ..... 250/214 R
6,950,687 B1 * 9/2005 Al-Ali ..... 600/310
2001/0035815 A1 * 11/2001 Fletcher et al. ..... 340/10.6
2003/0043596 A1 * 3/2003 Pai et al. ..... 363/16
2003/0117025 A1 * 6/2003 Rouquette ..... 307/147
2004/0008579 A1 * 1/2004 Olivier et al. ..... 367/16
2004/0129578 A1 * 7/2004 McLachlan et al. ..... 205/742

* cited by examiner

*Primary Examiner*—Brian Sircus
*Assistant Examiner*—Daniel Cavallari
(74) *Attorney, Agent, or Firm*—Stevens & Showalter LLP

(57) ABSTRACT

An interface cable for providing a connection between an AC power source and a DC sensor. The interface cable includes a shroud portion containing a power convertor for converting power from an AC power source to a DC power output for powering a DC sensor. The shroud portion additionally includes a sensor interface for converting an output from the DC sensor to an output comparable to an output provided by an AC sensor for connection to controller configured for an AC sensor. The shroud portion is formed as a compact cylindrical structure integral with first and second cable portions whereby the interface cable provides a readily installed interface for connecting a DC sensor to a machine configured for operation with an AC sensor.

8 Claims, 2 Drawing Sheets

SENSOR INTERFACE CABLE

BACKGROUND OF THE INVENTION

1. Field of the Invention

The present invention is directed to a cable for use in providing connections to sensors. More particularly, the invention provides an interface cable for connecting a sensor to a power source and for conveying an output from the sensor to a control device.

2. Description of Related Prior Art

Sensors are used for a variety of applications including sensing the presence or absence of articles and sensing a distance or proximity of an article to the sensor, such as may be required for a process control application. In particular, ultrasonic sensors are widely used for numerous sensing applications for process control of production and packaging operations. Such sensing applications include container presence/absence detection, container size detection, product level detection, container orientation detection, container counting operations, material web control, tamper/safety seal detection, surface coating detection, as well as many others. Typically, specification of sensors at particular locations on a production or process machine is an integral part of the control system design to enable the machine to operate as intended.

Ultrasonic sensors require a power source and include a pair of power input connections for powering the sensor, and additionally include a pair of sensor output connections for providing an output to a controller for detecting the signal from the sensor. Further, the sensors are either configured to operate with an AC power source or a DC power source with a corresponding sensor output connection, where the output connection for the AC sensor is a switching output which is either normally open or normally closed, and the output connection for the DC sensor is either a current sourcing output on one of the output lines or a current sinking output on the other of the output lines.

Production or process machines incorporating sensors are often designed with wiring for the sensors built into the structure of the machine to facilitate power connection to the sensor and to provide sensor output connections to a process controller. However, when an application requires the use of DC sensors on a machine wired for AC sensors, or the provision of DC power from an AC source, it is necessary to convert the power supply and the sensor output to be compatible with the existing wiring. In the past, this has typically required installation of equipment, such as separately mounted equipment boxes, for providing conversion from AC power to DC power and for providing a conversion of the DC sensor output to make the output compatible with the AC sensor leads to be operative with the process controller wired to the sensor leads.

SUMMARY OF THE INVENTION

An interface cable for providing a connection between an AC power source and a DC sensor and for converting an output from the DC sensor to an output comparable to an output provided by an AC sensor for connection to controller configured for an AC sensor. The shroud portion is formed as a compact structure integral with first and second cable portions whereby the interface cable provides a readily installed interface for connecting a DC sensor to a machine configured for operation with an AC sensor.

In one aspect of the invention, an interface cable is provided which is adapted to connect to a sensor, the interface cable comprising: a unitary cable structure comprising first and second cable portions; the first cable portion comprising first power supply leads and first sensor leads; the second cable portion comprising second power supply leads and at least one second sensor lead; a power convertor enveloped in a shroud formed integrally with the cable between the first and second cable portions; a sensor interface located in the shroud and forming a connection between the first sensor leads and the second sensor lead; the power convertor converting power input from the first power supply leads to a power form for powering a sensor, and the sensor convertor converting a sensor output provided through the second sensor lead to a different sensor output form for the first sensor leads.

In another aspect of the invention, an interface cable is provided which is adapted to connect to a sensor, the interface cable comprising: an integrated power convertor; a sensor interface; an elongated shroud structure comprising a potting material encasing the integrated power convertor and the sensor interface; a unitary cable structure comprising first and second cable portions integral with the elongated shroud structure, the first cable portion comprising first power supply leads and first sensor leads the second cable portion comprising second power supply leads and at least one second sensor lead; the power convertor converting AC power input from the first power supply leads to a DC power form for powering a DC sensor; and the sensor convertor converting a sensor output provided through the second sensor lead to a different sensor output form for the first sensor leads.

Other features and advantages of the invention will be apparent from the following description, the accompanying drawings and the appended claims.

DETAILED DESCRIPTION OF THE PREFERRED EMBODIMENT

Figure 1:
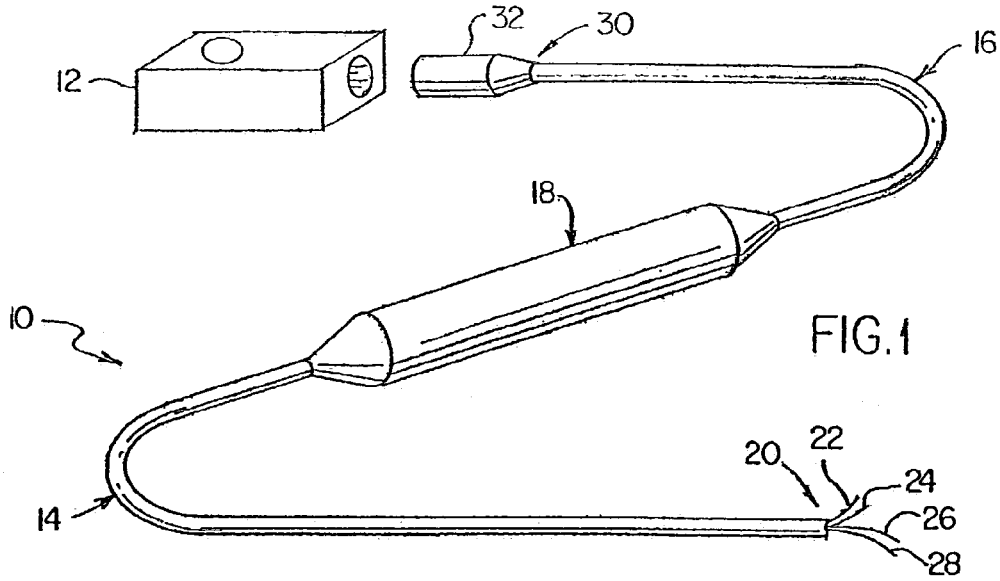
FIG. 1 is a perspective view of the interface cable of the present application.

Referring to FIG. 1, the present application provides an interface cable 10 which is adapted to provide a connection between a sensor 12 and a power source and a process controller 64 (FIG. 2), where power is provided by an AC power source 38 and the sensor 12 is a DC sensor such as, for example, an ultrasonic sensor sold under the SUPER-PROX® name by Hyde Park Electronics LLC, of Dayton, Ohio. The interface cable 10 comprises a first cable portion 14, a second cable portion 16 and an interface portion, defined by an elongated shroud structure 18, formed integrally with the first and second cable portions 14, 16. The first cable portion 14 terminates in a first cable end 20 comprising first power leads or lines 22, 24 for connection to an AC power source and first sensor leads or lines 26, 28 for connection to a process controller 64. The second cable portion 16 terminates in a second cable end 30 formed by a connector 32 for connection to the sensor 12, the connector including at least one second sensor line and also including second power lines for supplying DC power to the sensor 12, as will be described further below.

Figure 2:
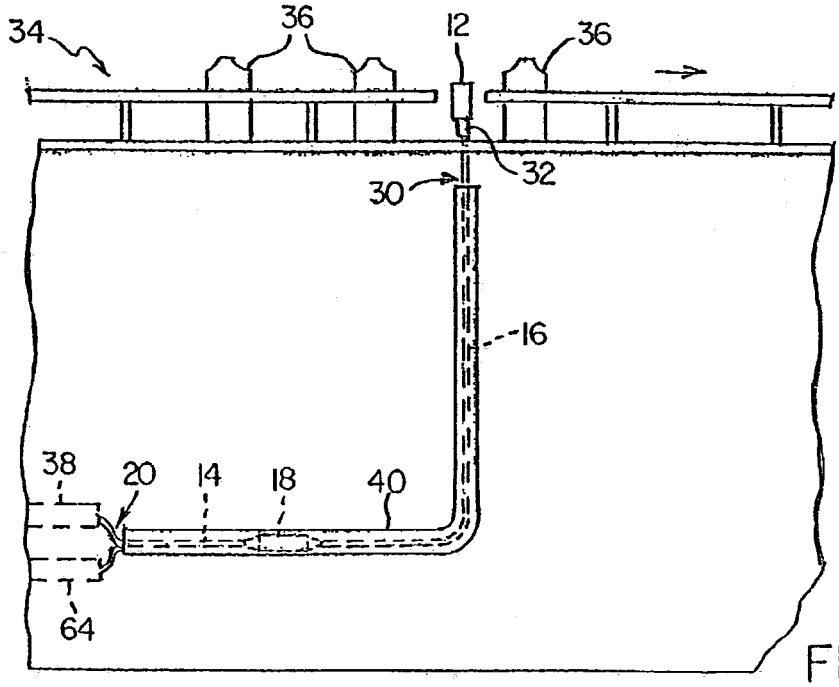
FIG. 2 is a side elevational view illustrating a process machine employing the interface cable of the present application.

Referring additionally to FIG. 2, the interface cable 10 of the present invention is illustrated in use on a process machine 34 incorporating the sensor 12 for sensing the presence or absence of articles 36 passing through the machine 34. The machine 34 is configured to provide an AC source 38 of power, the AC source 38 being located in close proximity to the desired sensor location. Further, a conduit structure 40, i.e., a 1 inch conduit, may be provided for guiding and containing the sensor power lines,and sensor output lines. Depending on the particular application of the machine 34, such as the particular characteristics of the article 36 to be conveyed through the machine 34, a user may specify a DC sensor rather than an AC sensor in order to control the machine 34 with a sensor having optimum characteristics for the particular process application. The interface cable 10 provides a means for readily connecting a DC sensor in a machine 34 configured for AC sensor applications, including converting the supply power from AC to DC and converting a DC sensor output to an AC compatible switching output without requiring restructuring of the machine 34 or mounting of additional conversion equipment. Further, the interface cable 10 is sized to fit into the conventional cable conduit 40 provided on the machine 34. Accordingly, the implementation of a DC sensor 12 with the associated interface cable 10 is substantially similar to an installation incorporating an AC sensor.

Figure 3:
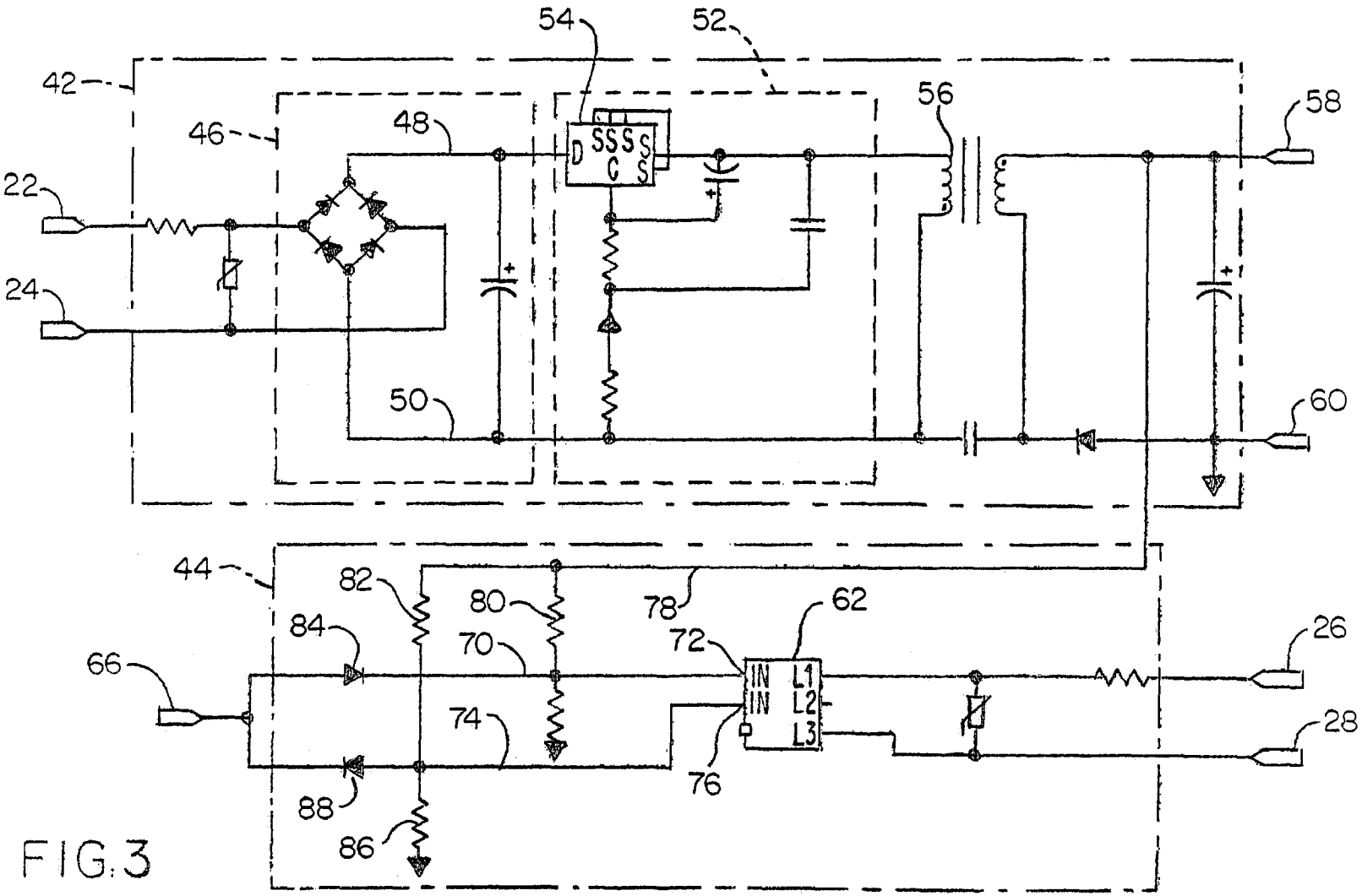
FIG. 3 is a schematic illustrating the power convertor and sensor interface circuits of the shroud portion of the interface cable.

Referring to FIG. 3, an electrical schematic is shown illustrating a power convertor 42 and a sensor interface 44 which are enveloped in the shroud structure 18. The power convertor 42 generally comprises a switching power supply including a full wave rectifier 46 for converting an AC power input provided on lines 22 and 24 to a DC output at leads or lines 48 and 50. Section 52 of the power convertor 42 uses pulse width modulated (PWM) control and comprises an integrated circuit switcher 54 which operates with a transformer 56 to provide an output of approximately 18 VDC at leads or lines 58, 60 for powering the sensor 12. One example of an integrated circuit switcher 54 that can be used in the present invention is an LNK 501 LinkSwitch sold by Power Integrations, Inc. of San Jose, Calif. The power convertor 42 is capable of operating with input voltages ranging from about 85 VAC to 265 VAC while providing a substantially constant DC output of 15–19 VDC on the lines 58, 60.

The sensor interface 44 comprises an optoisolator triac 62, such as an MOC 3063-M produced by Motorola of Phoenix, Ar. The optoisolator triac 62 provides a switching output across lines 26 and 28 whereby the process controller 64 (FIG. 2) connected to the lines 26, 28 may detect the switching condition of the optoisolator triac 62 corresponding to a sensor output received on a second sensor lead or line 66. For example, the switching condition of the optoisolator triac 62 may be determined by applying a current-limited AC voltage source (load) across the lines 26, 28 and the process controller 64 detecting the presence or absence of current as an indication of the condition of the switch at the sensor interface 44. The sensor signal provided on the sensor line 66 may be in the form of either a current sourcing output or a current sinking output to trigger the optoisolator triac 62. The sensor line 66 branches to a sourcing line 70 connected to a first pin 72 of the optoisolator triac 62, and a sinking line 74 connected to a second pin 76 of the optoisolator triac 62. Each of the sourcing line 70 and sinking line 74 are provided with a voltage of approximately 9 VDC biasing voltage via power line 78 from the output line 58 of the power convertor 42 and respective 2K resistors 80, 82.

When the output of the sensor 12 comprises a current sourcing output on the sensor line 66, current flows through a diode 84 in the sourcing line 70 to the first pin 72. The second pin 76 provides a connection via a 2K resistor 86 so that current flow is generated through a photodiode (not shown) in the optoisolator triac 62 between pins 72, 76 to change the switching condition across the first sensor lines 26, 28. When the output of the sensor 12 comprises a current sinking output on the line 66, a connection from the voltage of approximately 9 VDC provided at the sourcing line 70 flows through the first pin 72 to the second pin 76 and through a diode 88 in the sinking line 74 so that a current flows to the sinking output to thereby activate the photodiode (not shown) in the optoisolator triac 62 to change the switching condition, i.e., closes a connection, across the first sensor lines 26, 28.

The particular components required to form the circuits for the power convertor 42 and sensor interface 44 will be readily apparent to one skilled in the art. Additional information regarding components for forming these circuits may also be obtained from product data sheets available from the product manufacturers and suppliers for the integrated circuit switcher 54 and optoisolator triac 62.

Figure 4:
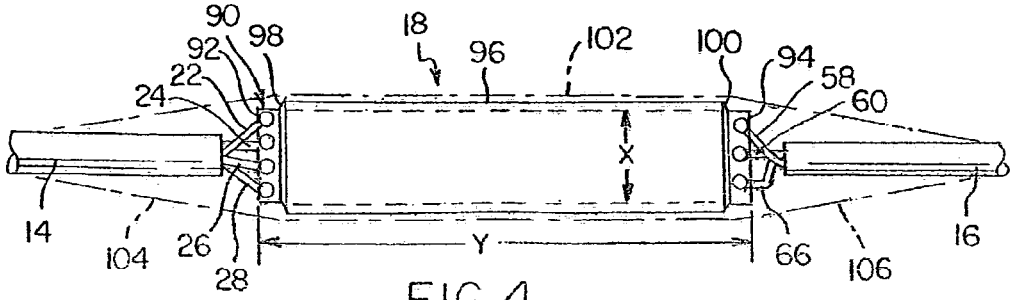
FIG. 4 is a top plan view of the shroud portion of the interface cable with the overmold material illustrated in phantom lines to show the connection between the first and second cable portions and the shroud portion.

Referring to. FIG. 4, the power convertor 42 and sensor interface 44 are provided on a printed circuit board 90. The printed circuit board 90 is configured as an elongated structure having a width dimension x which is substantially smaller than its length dimension y. In the illustrated embodiment, the x dimension is approximately 0.670 inches and the y dimension is approximately 3.4 inches, such that the length of the circuit board 90 is approximately 5:1 times as long as its width. The circuit board 90 has opposing longitudinal edges 92, 94 defining a connection area for attachment and electrical connection of the ends of the first and second cable portions 14, 16 to the circuit board 90. Specifically, the AC power lines 22, 24 and first sensor lines 26, 28 connect to the printed circuit board 90 at the edge 92, and the DC output lines 58, 60 and the sensor line 66 connect to the circuit board 90 at the edge 94.

The circuit board 90 is encased in a potting material 96, such as an epoxy material. In the illustrated embodiment, the potting material 96 is molded around the circuit board 90 in an elongated cylindrical shape having a diameter of approximately 0.75 inches. Also, the potting material 96 is formed with a length which is less than the length of the circuit board 90 such that approximately 0.15 inches of each longitudinal edge 92, 94 of the circuit board 90 is exposed adjacent the ends 98, 100 of the potting material 96. Further, the circuit board 90, potting material 96 and associated ends of the first and second cable portions 14, 16 are covered with an overmold material 102 which is preferably formed of polyvinyl chloride (PVC). The overmold material 102 is molded around the cylindrical exterior of the potting material 96 and defines tapered end portions 104, 106 which taper in opposing longitudinal directions over the first and second cable portions 14, 16. The taper portions 104, 106 provide a smooth transition between the shroud portion 18 and the first and second cable portions 14, 16 which facilitates passage of the interface cable through passageways during placement or installation on a machine, such as when being installed in the conduit 40 on the process machine 34. It may be noted that the first cable portion 14 comprises 18 AWG cable, the cable portion 14 having a diameter of approximately 0.28 inches, and the second cable portion 16 comprises 22 AWG cable, the cable portion 16 having a diameter of approximately 0.2 inches. The overmold material 102 forms a moisture resistant covering around the circuit board 90, including the connections between the longitudinal edges 92, 94 and the ends of the first and second cable portions 14, 16, such that the shroud structure 18 and cable portions 14, 16 comprise an integral moisture proof structure.

The overall length of the shroud structure 18, including the tapered end portions 104, 106, is approximately 6 inches, and the diameter of the shroud structure 18 is approximately 0.950 inches. Thus, the interface cable 10 described herein is adapted to fit within a conventional 1 inch cable conduit and therefore may be readily incorporated into the cable conduits for existing process machines.

From the above description, it should be apparent that the interface cable 10 of the present application addresses all of the electrical interface requirements, i.e., power conversion and sensor output interfacing, associated with implementing a DC sensor in an application, such as a process machine installation, originally configured for an AC sensor. Further, the shroud portion 18 and first and second cable portions 14, 16 form an integral structure which is effective for isolating the electrical components and connections associated with the power convertor 42 and the sensor interface 44 from water/moisture and dust or other contaminants for ensuring protection and continued operation of these electrical components.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An interface cable adapted to connect to a sensor, said interface cable comprising:

a unitary cable structure comprising first and second cable portions;

said first cable portion comprising first power supply leads and first sensor leads having first and second ends;

said second cable portion comprising second power supply leads and at least one second sensor lead having first and second ends;

an elongated shroud structure including an elongated circuit board having a longer longitudinal dimension than a width dimension and comprising opposing first and second longitudinal edges;

said first end of said first power supply leads and said first sensor leads of said first cable portion being attached to said first longitudinal edge of said elongated circuit board;

said first end of said second power supply leads and said at least one second sensor lead of said second cable portion being attached to said second longitudinal edge of said elongated circuit board;

a power convertor mounted to said elongated circuit board for converting AC power supplied to said second end of said first power supply leads to DC power to be supplied to said second end of said second power supply leads located distally from said circuit board;

a sensor interface mounted to said elongated circuit board and forming a connection between said first sensor leads and said at least one second sensor lead to convert either a current sourcing or current sinking output, supplied at said second end of said at least one second sensor lead to a switching output, to be supplied to said second end of said first sensor leads located distally from said circuit board;

a potting material encasing said elongated circuit board including said power convertor and said sensor interface; and an overmold material surrounding said potting material and extending past said first and second ends of said circuit board and covering said first ends of said first and second cable portions.

2. The interface cable of claim 1 wherein said sensor convertor comprises an optoisolator triac.

3. The interface cable of claim 1 wherein said elongated shroud structure defines an elongated cylindrical member having a length dimension extending in a direction of extension of said first and second cable portions from said first and second edges of said circuit board, said cylindrical member including tapered ends tapering from an outer surface of said elongated cylindrical member toward said first and second cable portions.

4. The interface cable of claim 3 wherein said elongated shroud structure defines a maximum diameter dimension which is less than 1 inch.

5. The interface cable of claim 1 wherein said potting material comprises an epoxy material.

6. The interface cable of claim 1 wherein said overmold material comprises PVC.

7. The interface cable of claim 1 wherein said circuit board comprises a length that is at least about five times its width.

8. The interface cable of claim 7 wherein said overmold defines a circumference of said elongated shroud structure, and a diameter of said elongated shroud structure across said circumference is no more than one inch.

* * * * *

UNITED STATES PATENT AND TRADEMARK OFFICE

CERTIFICATE OF CORRECTION

PATENT NO. : 7,105,954 B2
APPLICATION NO. : 10/614854
DATED : September 12, 2006
INVENTOR(S) : Rand Kalani Ray It is certified that error appears in the above-identified patent and that said Letters Patent is hereby corrected as shown below:

Col. 2, line 23, "first sensor leads the second cable" should read --first sensor leads; the second cable--;

Col. 4, line 13, "26, 28. When the output" should read --26, 28. (New paragraph) When the output--;

Col. 4, line 36, "circuit board 90 is approximately 5:1 times" should read --circuit board 90 is approximately 5.1 times--;

Col. 4, line 67, "comprises 18 AWG cable, " should read --comprises 18 AWG cable (no bold)--;

Col. 5, line 2, "comprises 22 AWG cable, " should read --comprises 22 AWG cable (no bold)--.

Signed and Sealed this

Twenty-second Day of May, 2007

JON W. DUDAS
*Director of the United States Patent and Trademark Office*